US010178905B2

(12) United States Patent
Sanchez et al.

(10) Patent No.: US 10,178,905 B2
(45) Date of Patent: Jan. 15, 2019

(54) PACKAGING AND APPLICATION DEVICE

(71) Applicant: L'OREAL, Paris (FR)

(72) Inventors: Marcel Sanchez, Aulnay sous Bois (FR); Eric Caulier, Maignelay (FR); Audrey Thenin, Meudon (FR); Wendy Annonay, Paris (FR)

(73) Assignee: L'OREAL, Paris (FR)

( * ) Notice: Subject to any disclaimer, the term of this patent is extended or adjusted under 35 U.S.C. 154(b) by 5 days.

(21) Appl. No.: 14/780,705

(22) PCT Filed: Mar. 25, 2014

(86) PCT No.: PCT/IB2014/060133
§ 371 (c)(1),
(2) Date: Sep. 28, 2015

(87) PCT Pub. No.: WO2014/155287
PCT Pub. Date: Oct. 2, 2014

(65) Prior Publication Data

US 2016/0051031 A1 Feb. 25, 2016

(30) Foreign Application Priority Data

Mar. 27, 2013 (FR) ..... 13 52778

(51) Int. Cl.
*A45D 40/26* (2006.01)
*B65D 85/00* (2006.01)
*A45D 40/00* (2006.01)

(52) U.S. Cl.
CPC ..... *A45D 40/267* (2013.01); *A45D 40/265* (2013.01); *B65D 85/70* (2013.01); *A45D 2040/0012* (2013.01); *A45D 2200/10* (2013.01)

(58) Field of Classification Search
CPC ..... A46B 1/00; A46B 3/04; A46B 11/0003; A45D 40/262; A45D 40/265; A45D 40/267; A45D 2040/0012
See application file for complete search history.

(56) References Cited

U.S. PATENT DOCUMENTS 6,505,373 B2 * 1/2003 van Gelder ..... A46B 5/0025 15/167.1
2003/0178043 A1 * 9/2003 Gueret ..... A45D 40/262 132/313

(Continued)

FOREIGN PATENT DOCUMENTS

CN 1150748 A 5/1997
CN 101217898 A 7/2008

(Continued)

OTHER PUBLICATIONS

Amber; "Review: Milani Total Lash Cover Mascara;" Beauty Junkies Unite; Jun. 6, 2012; XP002716664; retreived from http://www.beautyjunkiesunite.com/WP/2012/06/06/reviews-photos-before-after-milani-total-lash-cover-mascara/.

(Continued)

*Primary Examiner* — Jennifer C Chiang
*Assistant Examiner* — Bradley Oliver
(74) *Attorney, Agent, or Firm* — Oliff PLC

(57) ABSTRACT

Applicator (3) for applying a cosmetic, makeup or care product (P) to the skin, the lips or the eyelashes and/or eyebrows, comprising: a stem (8), and an applicator member (10) located at one end of the stem (8) and comprising: a solid core (11) extending along a longitudinal axis (X), formed with one or more protuberances (13) and comprising one or more cavities (16), in particular through-cavities, and (Continued)

Figure 1:
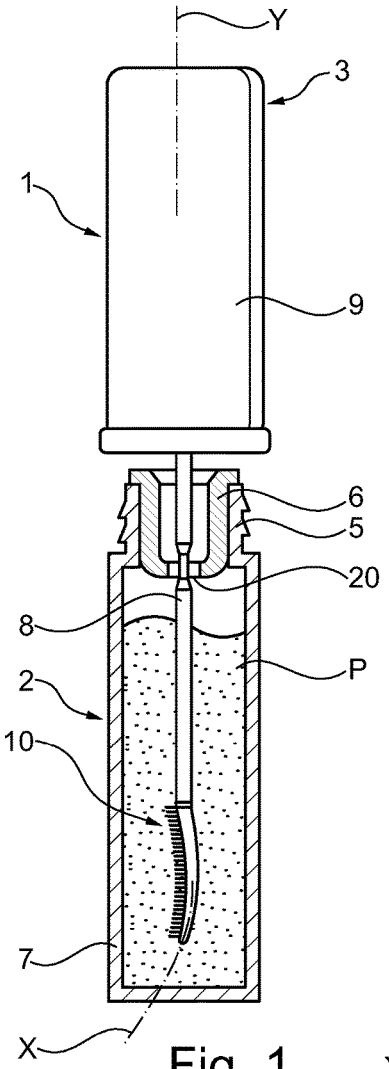

an envelope (14) located on the core (11), carrying applicator elements (12) and/or defining an application surface (15).

22 Claims, 3 Drawing Sheets

(56) References Cited

U.S. PATENT DOCUMENTS

| | | | | |
|---|---|---|---|---|
| 2005/0034740 | A1 | 2/2005 | Eckers et al. | |
| 2007/0033760 | A1* | 2/2007 | Dumler | A45D 40/262 15/187 |
| 2008/0178901 | A1* | 7/2008 | Montoli | A45D 40/262 132/218 |
| 2009/0028627 | A1 | 1/2009 | Gueret | |
| 2009/0072610 | A1 | 3/2009 | Sorrentino et al. | |
| 2009/0114239 | A1 | 5/2009 | Chen | |
| 2012/0211019 | A1 | 8/2012 | Wolfsgruber | |
| 2013/0291320 | A1* | 11/2013 | Kirchhofer | A46B 1/00 15/22.1 |

FOREIGN PATENT DOCUMENTS

| | | | |
|---|---|---|---|
| FR | 2922422 | A1 | 4/2009 |
| WO | 96/02165 | A1 | 2/1996 |
| WO | 2009/062267 | A2 | 5/2009 |
| WO | 2012/001580 | A1 | 1/2012 |
| WO | 2012/093085 | A2 | 7/2012 |

OTHER PUBLICATIONS

Jul. 10, 2014 Search Report issued in International Patent Application No. PCT/IB2014/060133.
Jul. 10, 2014 Written Opinion issued in International Patent Application No. PCT/IB2014/060133.
Mar. 31, 2017 Office Action issued in Chinese Patent Application No. 201480018278X.

* cited by examiner

PACKAGING AND APPLICATION DEVICE

The present invention relates to an applicator for applying a cosmetic product to the skin, the lips or the eyelashes and/or eyebrows, and also to a packaging and application device comprising such an applicator and a container containing the product to be applied.

Applicator members made of a material having low rigidity, making the applicator member flexible and the application of the product comfortable, are known.

Application US 2007/0033760 describes a mascara applicator comprising a body that carries applicator elements, is made of a flexible material and is fixed to an internal structure made of a rigid material.

Application FR 2 922 422 discloses the use of materials having different hardnesses for producing the core and the applicator elements.

In this type of applicator, the applicator member, which is very flexible, can increase in volume under the effect of the solvents contained in the product, and can remain stuck in the container when the applicator is removed, detaching from the stem which carries it. Moreover, on account of the high deformability of the applicator member, the application of the product may lack precision.

Application US 2012/0211019 describes a mascara applicator comprising a body that carries applicator elements and is moulded onto a hollow core, the body and the core being made of materials having different hardnesses.

Application US 2005/0034740 discloses an applicator comprising a support sleeve injected onto and into recesses of a rod-shaped core.

Application US 2009/0114239 describes an applicator comprising a rigid body disposed on a lateral side of a flexible body, each body carrying applicator elements.

There exists a need to further improve applicators comprising a flexible applicator member, so as to reduce the risk of accidental detachment of the applicator member while the latter is being removed from the container, and to improve makeup precision during the application of the product.

There also exists a need to benefit from applicators that are visually attractive for the consumer and afford new possibilities from an aesthetic point of view.

The invention aims to meet all or some of these objectives and achieves this aim by virtue of an applicator for applying a cosmetic, makeup or care product to the skin, the lips or the eyelashes and/or eyebrows, comprising:

- a stem, and
- an applicator member located at one end of the stem and comprising:
  - a core, advantageously solid, extending along a longitudinal axis, formed with one or more protuberances and advantageously comprising one or more cavities, in particular through-cavities, and
  - an envelope located on the core, carrying applicator elements and/or defining an application surface.

The envelope is preferably made of a material having a hardness less than that of the material of which the core is made. Also preferably, the envelope does not cover the protuberance or protuberances.

The cavity or cavities may each have an axis perpendicular to the longitudinal axis of the core.

At least one of the protuberances of the core is advantageously visible, since it extends through the envelope.

The protuberance or protuberances of the core improve the hold of the envelope on the core and their visible nature also gives them an additional function by creating a visible pattern.

Thus, for example, the protuberance or protuberances can impart information such as a logo or a name, for example that of the company selling the applicator.

The cavity or cavities improve the retention of the envelope on the core.

It is possible for the core not to have a longitudinal channel. It is possible for the envelope not to pass through the core, except possibly by way of a small number of material bridges, for example fewer than five thereof, which have a relatively small section, in particular less than 2.5 $mm^2$ for each material bridge.

The subject of the invention, according to another of its aspects, is an applicator for applying a cosmetic, makeup or care product to the skin, the lips or the eyelashes and/or eyebrows, comprising:

- a stem, and
- an applicator member located at one end of the stem and comprising:
  - a core wider than thicker in cross section, extending along a longitudinal axis, and
  - an envelope located on the core, carrying applicator elements and/or defining an application surface.

The flexible envelope is stiffened by virtue of the rigid core, while preserving elasticity in a direction perpendicular to the flattening direction of the core.

The cross section of the core thus allows adequate deformation of the applicator member during application.

Materials Used

The envelope is advantageously made of a thermoplastic material, in particular an elastomer, for example SEBS, a silicone, latex, butyl, EPDM, a nitrile, a thermoplastic elastomer, a polyester elastomer, a polyamide elastomer, a polyethylene elastomer or a vinyl elastomer, a polyolefin such as PE or PP, PVC, EVA, PS, PET, POM, PA or PMMA. It is possible in particular to use the materials known under the trade names Hytrel®, Cariflex®, Alixine®, Santoprene®, Pebax®, this list not being limiting.

The stem and the core are advantageously moulded in one piece, for example of POM, PE, PP, PBT, PA or PET.

The envelope may be made of a material having a hardness of between 40 Shore A and 80 Shore D, better still between 50 Shore A and 95 Shore A, while the core is made of a material having a hardness greater than that of the material of which the envelope is made. The core is for example made of POM and the envelope of SEBS.

Envelope

The envelope is advantageously overmoulded on the core, the overmoulding of the envelope preferably being carried out such that it surrounds the protuberance or protuberances of the core.

The overmoulding thickness may be equal to the thickness of the protuberance or protuberances. Thus, the protuberance or protuberances is/are flush with the surface of the envelope but do not protrude beyond the envelope.

In one variant, the overmoulding thickness is less than the thickness of the protuberance or protuberances. Thus, the protuberance or protuberances project(s) slightly from the envelope by a height equal to the difference between the thickness of the envelope and the thickness of the protuberances. This height is preferably between 0 mm and 0.4 mm, better still between 0.1 mm and 0.2 mm.

In a further variant, the overmoulding thickness is greater than the thickness of the protuberance or protuberances. The latter is/are thus set back slightly from the surface of the envelope, by a distance equal to the difference between the thickness of the envelope and the thickness of the protuberance or protuberances. This distance is in particular between 0 mm and 0.4 mm, better still between 0.1 mm and 0.2 mm.

The envelope and the core may be made of materials having different colours, in particular when the overmoulding thickness is equal to the thickness of the protuberances. Thus, the protuberance or protuberances is/are clearly visible. For example, the protuberance or protuberances is/are made of a lighter material than the envelope, or vice versa.

When the envelope defines an application surface, the latter may have flocking. The applicator can thus serve for the application of a cosmetic product to the lips or eyelids.

In the variant in which the envelope carries applicator elements, which are in particular moulded in one piece with the envelope, said applicator elements may consist of spikes of any shape.

The length of the applicator elements may be between 0.5 mm and 5 mm, better still between 2 mm and 3 mm.

Preferably, only one face of the envelope carries applicator elements and/or defines the application surface.

In one variant, two opposite faces of the envelope carry application elements and/or define the application surface.

In a further variant, the envelope comprises applicator elements at its distal end.

The length of the applicator elements can vary such that the envelope surface of the applicator member is not in the form of a cylinder of revolution. After wiping, product can remain in the concavity of the applicator member, making it possible to form a reserve of product for application. Moreover, the application of product to a row of eyelashes is rendered easier on account of the curvature of the applicator member.

The core of the applicator member may be inscribed in a cylinder having the same axis and the same diameter as the stem at its distal end.

The visible length of the applicator member may be between 10 mm and 35 mm, better still between 24 mm and 28 mm.

Core and Protuberance(s)

The protuberance or protuberances advantageously form(s) characters and/or other signs imparting information, in particular letters and/or numbers. This makes it possible to create aesthetic effects and/or to impart information to the user, for example to remind him of the brand of the product.

The user can optionally make use of this information during use of the applicator and application of the product, for example in order to correctly position the applicator member in relation to the eyelashes and/or eyebrows depending on the desired makeup result.

In one variant, the protuberances are applicator elements.

The core is advantageously devoid of protuberances at its distal and proximal ends.

The protuberance or protuberances may be visible on only one face of the applicator member. Preferably, this face is opposite the face that carries the applicator elements and/or defines the application surface. This makes it possible to improve the visibility of the protuberance or protuberances.

The core is advantageously concave with concavity towards the opposite side from the protuberances. When the applicator member passes through a wiping member, this can make it easier to remove product covering the protuberance or protuberances and make the latter visible.

The material of the envelope may enter the cavity or cavities in the core, in particular when the envelope is overmoulded on the core. The cavity or cavities in the core may or may not be through-cavities. Preferably, the cavity or cavities is/are through-cavities.

The core comprises for example two cavities, one at its distal end, the other at its proximal end.

The core may be formed by a piece connected to the stem of the applicator. The core is preferably produced by being moulded in one piece with the stem of the applicator. The stem can then have a shoulder at its junction with the core. The envelope can come axially into abutment with this shoulder. Preferably, the envelope lies, at its proximal end, in the continuation of the stem at its distal end, so as to avoid the formation of a step in the outer surface of the applicator at the junction between the stem and the envelope.

The core is preferably monolithic.

The core preferably comprises a curvilinear longitudinal axis, being curved about a single axis of curvature, but it may also be curved about a number of axes of curvature, for example two thereof, or be rectilinear. The two axes of curvature may be mutually parallel.

When the core comprises a flattened cross section, the ratio of its width to its thickness, at at least one point along its length, better still along at least half of its length, is preferably between 1.5 and 5.

Stem

At its end opposite the applicator member, the stem may be connected to a gripping member. The stem may be snap-fastened onto a part of this gripping member.

The stem may have a circular cross section.

The stem may have at least one elastically deformable flexible portion, being able to flex during application and/or when the applicator member is wiped.

The core may be fixed to the flexible portion of the stem. In particular, the flexible portion of the stem may have a housing, the core being inserted into this housing. The stem may have a housing, the flexible portion being engaged in this housing.

The flexible portion of the stem may be provided with an annular groove.

The flexible portion of the stem and the envelope may be produced in one piece.

Packaging and Application Device

A further subject of the invention is a device for packaging and applying a cosmetic, makeup or care product to the skin, the lips or the eyelashes and/or eyebrows, comprising an applicator according to the invention, as defined above, and a container containing the product to be applied.

The gripping member of the applicator may form a cap for closing the container in a sealed manner.

The container may have a member for wiping the applicator. The stem may have a narrowing which is positioned opposite the wiping member in the closed configuration of the container.

It may be advantageous, in the presence of a wiping member, for the latter to wipe off the product that covers the protuberance or protuberances during the removal of the applicator, so as to make the corresponding information visible. Thus, it may be advantageous to provide the protuberance or protuberances on the back of the applicator member, which is thus preferably smooth, the applicator elements being present on the opposite side.

Figure 2:
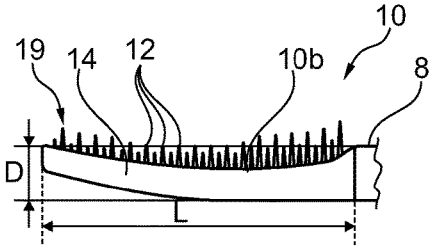
Figure 3:
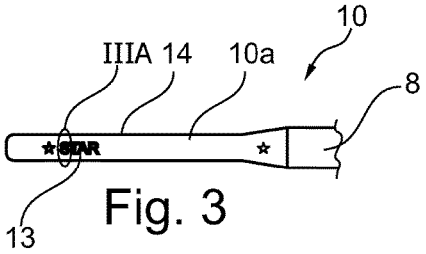
Figure 3A:
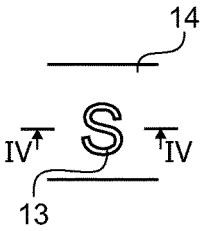
Figure 5:
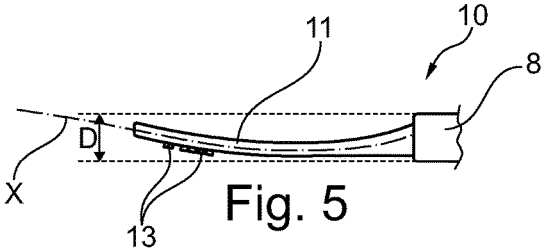
Figure 4:
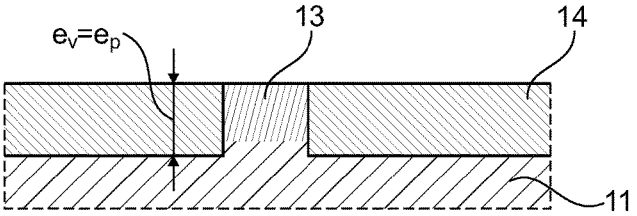
Figure 6:
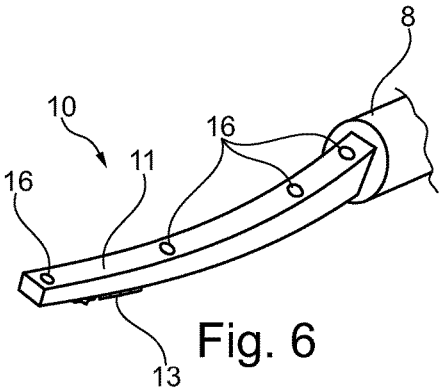
Figure 7:
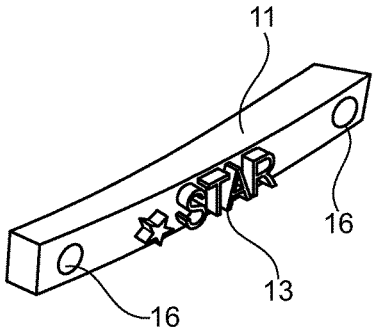
Figure 8:
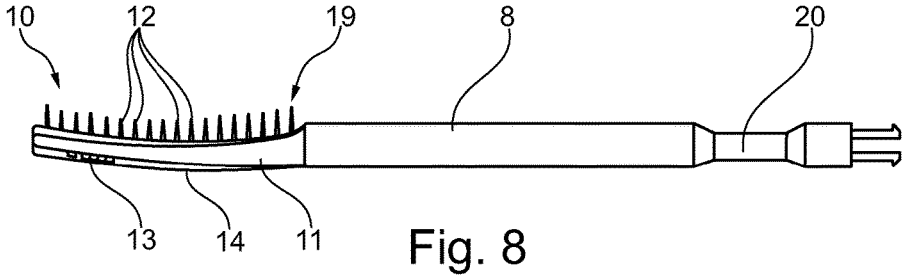
Figure 11:
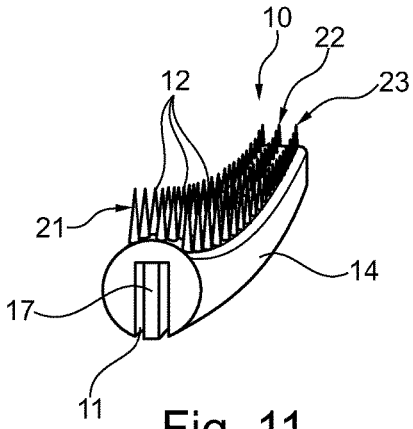
Figure 12:
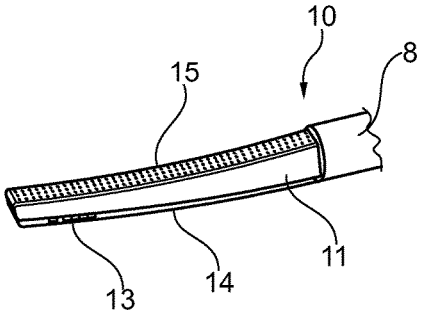
Figure 9:
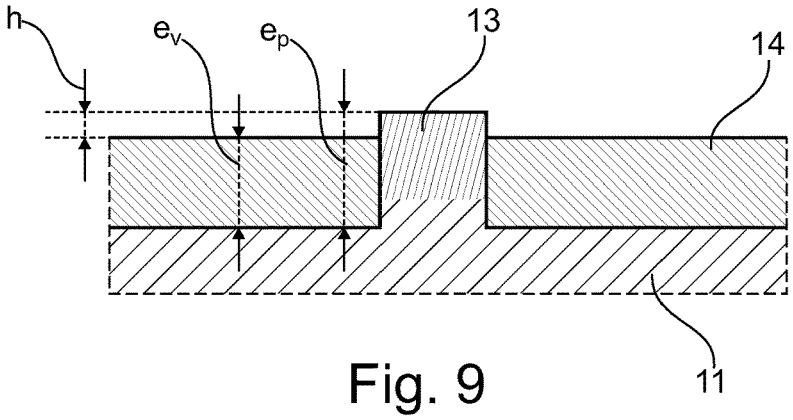
Figure 10:
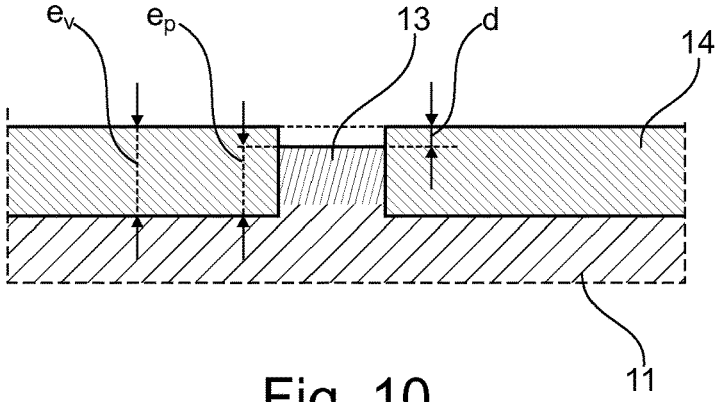
Figure 13:
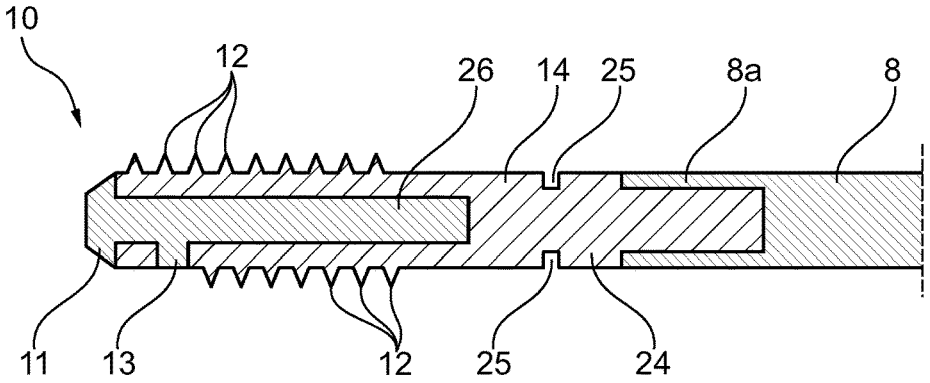

The invention may be better understood from reading the following detailed description of non-limiting implementation examples thereof, and with reference to the attached drawing, in which:

FIG. 1 schematically shows an example of a packaging and application device produced in accordance with the invention, in longitudinal section, FIG. 2 shows a side view of the applicator member from FIG. 1 on its own, FIG. 3 shows a bottom view of the applicator member from FIG. 1 on its own, FIG. 3A is a detail of the applicator member from FIG. 3, FIG. 4 is a section along IV-IV of the applicator member from FIG. 3A, FIG. 5 shows a side view of the core of the applicator member from FIGS. 1 to 3 on its own, FIG. 6 shows a top view of the core of the applicator member from FIGS. 1 to 3 on its own, FIG. 7 shows a bottom view of the core of the applicator member from FIGS. 1 to 3 on its own, FIG. 8 shows a side view of the stem and the applicator member from FIG. 1 on their own, FIGS. 9 and 10 are views similar to FIG. 4 of variant embodiments, FIGS. 11 to 12 show side views of variants of applicator members according to the invention, and FIG. 13 schematically shows a variant of an applicator according to the invention, in longitudinal section.

The packaging and application device 1 shown in FIG. 1 comprises a container 2 containing a product P to be applied to the eyelashes and/or eyebrows and an applicator 3 which may be fixed removably to the container 2.

The applicator 3 comprises a stem 8 of longitudinal axis Y, which is provided at one end with an applicator member 10, which will be described in detail below, and at the other end with a gripping member 9 that likewise forms a cap for closing the container 2 in a sealed manner. The latter comprises a body 7 provided at the top with a threaded neck 5 onto which the gripping member 9 can be screwed in order to close the container 2 in a sealed manner. In a variant, the applicator 3 can be fixed to the container 2 in some other way.

The neck 5 may accommodate, as illustrated, a wiping member 6 which is for example inserted into the neck 5. This wiping member 6 comprises for example a lip that defines a wiping orifice having a diameter adapted to that of the stem 8. The wiping member 6 may be of any type, connected to the container 2 or moulded together therewith. The wiping member 6 may also be adjustable. In a variant, the neck 5 of the container 2 may be attached.

In the example illustrated, the stem 8 comprises a rectilinear longitudinal axis Y, but if the stem 8 is not rectilinear, this does not depart from the scope of the present invention.

As illustrated in FIGS. 1 and 8, the stem 8 may have an annular narrowing 20, which is positioned opposite the lip of the wiping member 6 when the applicator 3 is fixed on the container 2.

The product P is intended for example to be applied to the eyelashes and/or eyebrows, as illustrated. It may comprise iron oxide, among other pigments, and an aqueous or organic solvent, depending on the formulation.

All or part of the applicator member 10 is schematically shown on its own in FIGS. 2 to 7, and the applicator member 10 and the stem 8 are schematically shown in FIG. 8.

The visible length L of the applicator member 10 is preferably between 10 mm and 35 mm, better still between 24 mm and 28 mm, being for example equal to 25 mm in the example in question.

The applicator member 10 comprises a core 11, visible in FIG. 5, that extends along a longitudinal axis X, which is curvilinear in the example described.

The core 11 is formed with a number of protuberances 13, which are visible in FIGS. 3 to 8.

The applicator member 10 comprises an envelope 14, which is overmoulded on the core 11 and, in the example in question, carries applicator elements 12 on one face 10*b*.

In the figures, the applicator member 10 is intended for application to the eyelashes and/or eyebrows, but the following applies for types of applicator member with or without applicator elements moulded together with the envelope.

As shown in FIGS. 3 and 3A, the protuberances 13 of the core 11 are visible through the envelope 14, the overmoulding of the envelope 14 being advantageously carried out such that it surrounds the protuberances 13 of the core 11 without covering them.

In the example described, the protuberances 13 of the core 11 are letters and signs imparting information, for example "*STAR".

The envelope 14 is made of a more flexible material than the core 11.

As can be seen in FIG. 3, the envelope 14 and the core 11 are preferably made of materials having different colours.

In the example described, the protuberances 13 are visible on only one face 10*a* of the applicator member 10, this face 10*a* being opposite the face 10*b* that carries the applicator elements 12.

As can be seen in FIG. 6, the core 11 is wider than it is thick in cross section. The applicator elements 12 are oriented approximately perpendicularly to the direction in which the core is flattened.

In the example in question, the core 11 narrows towards its distal end.

The core 11 is concave towards the opposite side from the protuberances 13. The applicator elements 12 are located on the side of the concavity of the core 11.

As shown in FIG. 2, the applicator member 10, without the applicator elements 12, is inscribed in a cylinder having the same axis and the same diameter D as the stem 8 at its distal end 8*a*. The core 11 is thus inscribed in this cylinder.

As shown in FIGS. 6 and 7, the core 11 may have through-cavities 16, which improve the anchoring of the envelope 14 on the core. These cavities are formed for example by holes, each having a diameter of less than 2 mm.

The applicator elements 12 are advantageously flexible, and the envelope 14 is preferably made from a thermoplastic elastomer.

The core 11 is solid, apart from the abovementioned cavity or cavities 16.

As shown in FIG. 2, the length of the applicator elements 12 can vary such that the envelope surface of the applicator member 10 follows a curve.

As can be seen in FIGS. 4 and 8, the thickness $e_v$ of the envelope 14 may be equal to the thickness $e_p$ of the protuberances 13. Thus, the protuberances 13 do not project from the outer surface of the envelope 14.

In a variant which is shown in FIG. 9, the thickness $e_v$ of the envelope 14 is less than the thickness $e_p$ of the protuberances 13. The protuberances 13 thus project from the envelope 14 by a height h which is preferably less than or equal to 0.4 mm.

In a further variant which is shown in FIG. 10, the thickness $e_v$ of the envelope 14 is more than the thickness $e_p$ of the protuberances 13. The latter are thus set back slightly from the surface of the envelope 14 by a distance d which is preferably less than or equal to 0.4 mm.

In the example in FIGS. 1 to 8, the envelope 14 comprises a row 19 of applicator elements 12 which are moulded in one piece with the rest of the envelope 14.

In a variant which is shown in FIG. 11, the envelope 14 comprises three rows 21, 22 and 23 of applicator elements 12. The central row 22 is for example straight, while the two other rows 21 and 23, which flank it, are oriented obliquely towards the outside of the applicator member 10.

In this figure, a material bridge 17 of the envelope can be seen, which passes through the core.

In the variant shown in FIG. 12, the envelope 14 defines a flocked application surface 15. The applicator 3 can then be used to make up the lips or the eyelids.

The flattened section of the core 11 gives the applicator member 10 increased flexibility in a direction perpendicular to the direction of flattening.

In the variant shown in FIG. 13, the stem 8 comprises an elastically deformable flexible portion 14, being able to flex during application and/or when the applicator member 10 is wiped. This flexible portion 24 is adjacent to the distal end 8*a* of the stem 8, and the applicator member 10 is connected to this flexible portion 24.

In the example described, the flexible portion 24 is provided with an annular groove 25.

The flexible portion 24 comprises a housing 26, the core 11 being inserted into this housing 26.

The flexible portion 24 and the envelope 14 are produced in one piece.

In the examples in FIGS. 1 to 12, only the face 10*b* of the envelope 14 carries the applicator elements 12 or defines the application surface 15. In the variant in FIG. 13, the two faces 10*a* and 10*b* of the envelope carry applicator elements 12.

The invention is not limited to the examples that have just been described.

Combining features of the illustrated examples into alternative forms that have not been illustrated would not constitute a departure from the scope of the present invention.

The height of the protuberances 13 may be less than or equal to 0.9 mm. It may also be greater, and the protuberances 13 of the core 11 may be applicator elements, such as spikes of any shape.

The envelope 14 may completely cover the distal end of the core 11, without applicator elements oriented in line with the core, and this can provide additional safety in respect of a hand movement in the direction of the eye.

In a variant, the envelope 14 may have applicator elements at its distal end.

In a further variant, the core 11 protrudes from the envelope 14 at its distal end, and the core 11 may have in this case a row of applicator elements so as to make up the eyelashes at the corner of the eye for example.

The applicator elements 12 are formed by spikes having a conical shape in the above-described examples. However, the invention is not limited to applicator elements in the form of conical spikes, and other forms of spikes or teeth are possible, for example having a flattened cross section.

The applicator elements 12 may comprise a material that has bacteriostatic properties and/or promotes slip and/or is magnetic.

The applicator 3 may be subjected to vibrations during use, and/or be heated, that is to say have a heating element, and/or be able to rotate. It is also possible for the applicator member 10 to be able to vibrate and to be heated or only to be able to vibrate or only to be heated or only to be able to rotate. When the applicator is able to rotate, the gripping member 9 may house an electric motor for rotating the stem.

The product P may be a product other than mascara and be suitable for application to the skin or the lips.

The expression "comprising a" should be understood as being synonymous with "comprising at least one".

The invention claimed is:

1. Applicator for applying a cosmetic, makeup or care product to the skin, the lips or the eyelashes and/or eyebrows, comprising:

a stem, and an applicator member located at one end of the stem and comprising:

a solid core extending along a longitudinal axis, formed with one or more protuberances, comprising one or more through-cavities, and not having a longitudinal channel, and an envelope located on the core, carrying applicator elements and/or defining an application surface, the envelope not passing through the core except by way of fewer than five material bridges.

2. Applicator according to claim 1, wherein at least one of the protuberances of the core is visible.

3. Applicator according to claim 1, wherein the core is wider than thicker in cross section.

4. Applicator according to claim 1, wherein the protuberance or protuberances project(s) from the envelope to a height less than or equal to 0.4 mm.

5. Applicator according to claim 1, wherein the thickness of the envelope around the protuberance or protuberances is equal to the thickness of the protuberance or protuberances.

6. Applicator according to claim 1, wherein the envelope is overmoulded on the core.

7. Applicator according to claim 1, wherein the protuberance or protuberances form(s) characters and/or other signs imparting information, in particular letters and/or numbers.

8. Applicator according to claim 1, wherein the envelope is made of a material having a hardness less than that of the material of which the core is made.

9. Applicator according to claim 1, wherein the envelope and the core are made of materials having different colours.

10. Applicator according to claim 1, wherein only one face of the envelope carries the applicator elements and/or defines the application surface.

11. Applicator according to claim 1, wherein the protuberance or protuberances is/are visible on only one face of the applicator member.

12. Applicator according to claim 11, wherein the face on which the protuberance or protuberances is/are visible is opposite to the face that carries the applicator elements and/or defines the application surface.

13. Applicator according to claim 1, wherein the core is concave towards the opposite side from the protuberances.

14. Applicator according to claim 1, wherein the stem comprises at least one elastically deformable flexible portion.

15. Applicator according to claim 14, wherein the flexible portion of the stem and the envelope are produced in one piece.

16. Device for packaging and applying a cosmetic, makeup or care product to the skin, the lips or the eyelashes and/or eyebrows, comprising an applicator as defined in claim 1 and a container containing the cosmetic, makeup or care product to be applied.

17. Applicator according to claim 1, wherein each material bridge of the envelope has a section less than 2.5 $mm^2$.

18. Applicator for applying a cosmetic, makeup or care product to the skin, the lips or the eyelashes and/or eyebrows, comprising:

a stem, and an applicator member located at one end of the stem and comprising:

a core wider than thicker in cross section, extending along a longitudinal axis, and not having a longitudinal channel, and an envelope located on the core, carrying applicator elements and/or defining an application surface, and having at least one material bridge which passes through the core, the envelope not passing through the core except by way of fewer than five material bridges.

19. Applicator according to claim 18, wherein the core is formed with one or more protuberances.

20. Applicator according to claim 18, wherein the core has one or more through-cavities.

21. Applicator according to claim 20, wherein the one or more through-cavities of the core have an axis perpendicular to the longitudinal axis of the core.

22. Applicator according to claim 18, wherein the core is solid.

* * * * *